US006512535B1

(12) United States Patent
Nagasaka et al.

(10) Patent No.: US 6,512,535 B1
(45) Date of Patent: Jan. 28, 2003

(54) LASER DRAWING APPARATUS AND LASER DRAWING METHOD

(75) Inventors: Kimio Nagasaka, Nirasaki (JP); Akira Miyamae, Fujimi-machi (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/543,511

(22) Filed: Apr. 6, 2000

(30) Foreign Application Priority Data

Apr. 8, 1999 (JP) ..... 11-101779

(51) Int. Cl.[7] ..... B41J 2/47
(52) U.S. Cl. ..... 347/251; 347/240
(58) Field of Search ..... 347/234, 237, 347/247, 248, 251, 240; 369/30.11, 30.14, 30.17, 47.48, 47.49

(56) References Cited

U.S. PATENT DOCUMENTS 4,736,352 A * 4/1988 Satoh et al. ..... 369/30.14

5,974,013 A * 10/1999 Kadono ..... 369/47.49

* cited by examiner

*Primary Examiner*—Hai Pham
(74) *Attorney, Agent, or Firm*—Harness, Dickey & Pierce, P.L.C.

(57) ABSTRACT

An object of the present invention is to provide a laser drawing apparatus wherewith it is possible to draw fine patterns at high speed with uniform fineness. In order to achieve that object, in the present invention, drawing is performed at high speed by moving a laser spot in the radial direction while turning a blank disk coated with a photosensitive material mounted on a turntable. A discretionary pattern 203 within a fan-shaped area having the turning center 201 of the blank disk as its center is divided into dots of the same size such as the small areas 209, pattern drawing is performed using such dots as units to be drawn by the laser spot, and the fineness of the pattern shape is enhanced.

12 Claims, 3 Drawing Sheets

LASER DRAWING APPARATUS AND LASER DRAWING METHOD

BACKGROUND OF THE INVENTION

1. Field of the Invention

This invention relates to laser drawing technology used in semiconductor manufacturing, micro-processing, and computer hologram manufacturing, etc.

2. Description of the Related Art

A conventional laser drawing apparatus is described with reference to FIG. 5. The laser drawing apparatus diagrammed in FIG. 5 is for manufacturing reticles (photo-exposure plates) used in the manufacture of integrated circuits.

A photographic dry plate 504 made by coating a glass substrate with a photosensitive material is placed on an XY turntable 501. The XY turntable 501 can be moved in the x axis direction by an air slider 502 and in the y axis direction by an air slider 503, driven by linear motors (not shown) contained inside the air sliders 502 and 503.

Meanwhile, a laser beam 112 output by a gas laser is transmitted through an optical modulator 103 and advances to a mirror 102. The transmitted light intensity of the laser beam 112 can be modulated by the optical modulator 103, and here is a value that is either some prescribed light intensity or zero light intensity. The beam reflected by the mirror 102 is reflected by a mirror 104, condensed by an object lens 105, and focused on the photographic dry plate 504.

In actual practice, when drawing on the photographic dry plate 504 with the laser beam 112, the air sliders 502 and 503 are controlled in accordance with the pattern being drawn, and the desired pattern is exposed on the photographic dry plate 504 while the laser beam 112 is repeatedly transmitted and interrupted by the optical modulator 103 in conjunction with that control. Ordinarily, the method employed is that of drawing the outline of the pattern, and then filling in the outline, as when drawing with a plotter.

Another proposed method is one wherein laser drawing is performed at high speed using a turntable and sliders, employing an optical disk mastering process, as described in Japanese Patent Application Laid-Open No. S59-171119. An example of a pattern drawn is given in FIG. 6.

Here, drawing is done with the turning speed of the turntable and the moving speed of the sliders held constant, with the turntable turning about a center at a center point 601. The resist coat surface on the glass plate is divided into dots at polar coordinates ($r_m$, $\theta_n$) Exposure is effected while modulating the light on the basis of information as to whether to expose or not expose the dots at each pair of coordinates.

However, when the XY table type laser drawing apparatus diagrammed in FIG. 5 is used in finely drawing complex patterns, the distance traveled each time by the air sliders 502 and 503 in the x and y directions becomes very minute, making it necessary to effect acceleration and deceleration during that time. Accordingly, the average movement speed becomes rather slow, whereupon the drawing time becomes long. Also, when filling in the interior with laser irradiation after forming the outer contour of the pattern, the amount of reciprocal motion becomes considerable, and, when drawing at high speed, not only are considerable loads imposed on the linear motors, but, simultaneously therewith, the reactions of the XY table 501 during acceleration and deceleration themselves become a cause of vibration, whereupon positioning precision and speed precision decline.

With the scheme diagrammed in FIG. 6, moreover, the turning speed of the turntable is fixed during drawing, wherefore the length in the circumferential direction of a dot 606 on the inner circumference is shortened, while the length of a dot 607 on the outer circumference is lengthened. Accordingly, the resolution of the drawn pattern 603 declines at the outer circumference, and precise patterns cannot be drawn.

SUMMARY OF THE INVENTION

With the problems noted in the foregoing in view, an object of the present invention is to provide a laser drawing apparatus and laser drawing method wherewith fine patterns can be drawn at high speed and uniform fineness.

In order to resolve the problems discussed in the foregoing, the laser drawing apparatus of the present invention comprises a turntable whereon is mounted material to be processed and which turns said material, a slider capable of linear movement, a laser that serves as a light source, an optical system for condensing laser light to form a laser spot on the material to be processed loaded on the slider, an optical modulator for varying the light intensity of the laser spot, and an oscillator for generating a clock signal for synchronizing control signals input to the optical modulator. Here, if r is the distance of the laser spot formed on the material to be processed from the turning center of the turntable, fc is the rotational frequency of the turntable, Wd is the length in the radial dimension of the laser spot formed on the material to be processed, and N is a positive integer, then the clock signal frequency fd is adjusted to $fd=rNfc/Wd$.

For a preferred aspect of the present invention, moreover, in the configuration described above, if r is the distance of the laser spot formed on the material to be processed from the turning-center of the turntable, fc is the rotational frequency of the turntable, Wd is the length in the radial dimension of the laser spot formed on the material to be processed, $\theta$ is the center angle in a fan-shaped area being drawn, and N is a positive integer, then the clock signal frequency fd may be adjusted so that $fd=2\pi rNfc/\theta Wd$.

It is preferable, moreover, that the turntable rotational frequency fc and the clock signal frequency fd be constant.

The configuration may also be made so that the turntable rotational frequency fc is constant, the oscillator is synchronized with the rotational frequency fc, and the clock signal frequency fd is varied according to the radius r.

It is also permissible to make the clock signal frequency fd constant, to further provide a signal generator for generating signals for controlling the rotational frequency fc of a spindle motor that is a drive source for the turntable, and to synchronize the clock signal frequency fd with the signal generator and vary that frequency according to the radius r.

As an embodiment aspect of the present invention, where the material to be processed is a blank plate coated with a photosensitive material, laser drawing is performed on that photosensitive material.

In the laser drawing method of the present invention, laser light is condensed to form a laser spot on revolving material to be processed, control signals input to an optical modulator are synchronized by a clock signal obtained from an oscillator, the clock signal frequency fd is adjusted so that $fd=rNfc/Wd$ where r is the distance of the laser spot formed on the material to be processed from the turning center of the material to be processed, fc is the rotational frequency of the material to be processed, Wd is the length in the radial dimension of the laser spot formed on the material to be processed, and N is a positive integer, the light intensity of the laser spot is varied by the optical modulator in synchronization with the control signals, and a discretionary pattern is laser-drawn on the material to be processed.

In a preferred aspect of the present invention, laser light is condensed to form a laser spot on revolving material to be processed, control signals input to an optical modulator are synchronized by a clock signal obtained from an oscillator, the clock signal frequency fd is adjusted so that $fd=2\pi rNfc/\theta Wd$, where r is the distance of the laser spot formed on the material to be processed, fc is the rotational frequency of the turntable, Wd is the length in the radial dimension of the laser spot formed on the material to be processed, θ is the center angle in a fan-shaped area being drawn, and N is a positive integer, the light intensity of the laser spot is varied by the optical modulator in synchronization with the control signals, and a discretionary pattern is laser-drawn on the material to be processed.

DESCRIPTION OF THE PREFERRED EMBODIMENTS

Embodiment aspects of the present invention are now described with reference to the drawings.

First Embodiment Aspect of Invention

A laser drawing apparatus and a laser drawing method using that laser drawing apparatus, in a first embodiment aspect of the present invention are now described with reference to FIGS. 1 to 3.

Figure 1:
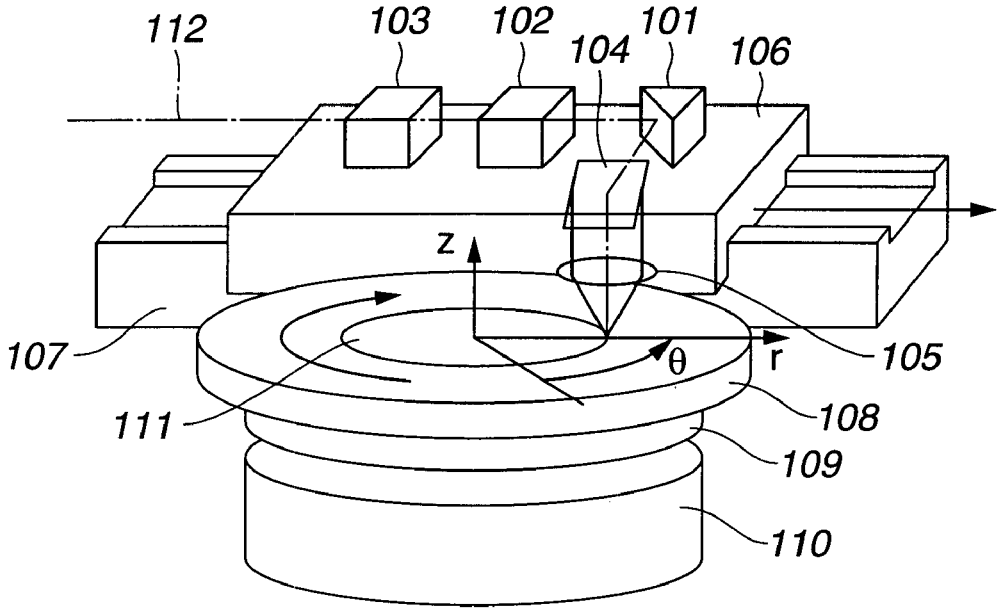
FIG. 1 is a model diagram of the overall structure of a laser drawing apparatus relating to an embodiment aspect of the present invention.

FIG. 1 is a model diagram of the overall structure of the laser apparatus. In this apparatus, a discretionary pattern is exposed on a photoresist applied to the surface of a substantially round glass blank disk 108 corresponding to the material to be processed.

In the apparatus diagrammed in FIG. 1, laser light 112 output from a laser light source (not shown) consisting of a gas laser or solid laser, after being transmitted through a optical modulator 103, is transmitted through a light deflecting device 102. The transmissivity of the optical modulator 103 varies according to the control signal, and the intensity of the laser light transmitted therethrough varies. The laser light transmitted through the light deflecting device 102 is reflected by mirrors 101 and 104, condensed by an objective lens 105 to form a laser spot, and directed onto the surface of the blank glass disk 108. The surface of the blank glass disk 108 is coated with a photoresist.

The blank glass plate 108 is secured by a chuck to the turntable 109 and turned by the driving power of a spindle motor 110. In this embodiment aspect, the rotational frequency of the turntable 109 is made constant.

The table 106, by moving on the air slide 107 with the elapse of time in the r direction, that is, from the inner circumference of the blank glass plate 108 toward the outer circumference thereof, exposes a pattern area 111 of the photoresist by a laser beam 112.

Next, a method of exposure (laser drawing method) on the blank disk by the laser drawing apparatus of this embodiment aspect is described with reference to FIG. 2.

If a pattern 203 is to be drawn inside an area 202, for example, the area 202 is accommodated inside the fan-shaped area formed in a circular circumferential portion (circular arc portion) between the line segments 206 and 208, with a center point 201 at the turning center of the blank glass disk 108. The portions demarcated inside the fan-shaped area, such as the small area 209, for example, respectively, are dots that are elements configuring the pattern, and the laser spot scans a line of dots arranged in a circular arc shape in the direction of the arrow 204. The hatched portions inside the area 202 are the dots that are exposed, while the other portions are dots that are not exposed.

An exposed dot may be formed by 1 pulse of laser irradiation within one revolution of the blank disk, or it may be formed with multiple pulses in multiple revolutions. If Wd is the length of a dot in the radial dimension of the blank disk (hereinafter called the dot width), K is the number of rotations required for the formation (exposure) of one dot, and Tp the air slider 107 feed pitch when the turntable 109 makes 1 revolution, then we have $$Wd=KTp. \tag{1}$$

The optical modulator 103 is generally driven in response to control signals input to an optical modulator driver. When the laser spot is swept in a circular arc shape, it is necessary to generate a clock signal so that 1 dot corresponds to 1 period (1 clock pulse). If fd is the frequency of this clock signal, r the radius for the circumferential portion (circular arc portion) scanned, and fc the rotational frequency of the turntable 109, then the length Ld of 1 dot in the circumferential direction (hereinafter called the dot length) is expressed $$Ld=2\pi rfc/fd. \tag{2}$$

It should be apparent that, in order to make fc constant, and make Ld constant for an radius r, the clock frequency fd must be varied according to r in formula (2).

When θ (rad) is made the center angle 207 in the fan-shaped area containing the area 202, r is made the radius at the position of the scanning laser spot, and N is a positive integer, then the only condition necessary in order for dots to be arranged in the radial direction at least on the line segments 206 and 208 is that there be, at any radial position, a difference of precisely an integer multiple of 1 dot length between the length of the circular arc in the fan-shaped area having the center angle θ, and that circular arc adjacent in the radial direction on the blank disk, giving us $$(r+Wd)\theta-r\theta=NLd, \tag{3}$$

that is, $$\theta Wd=NLd, \tag{4}$$

and the clock frequency fd of the control signal of the optical modulator 103, from formula (2), is given by]

$$fd=2\pi rNfc/\theta Wd. \quad (5)$$

Furthermore, as a condition for obtaining good uniform resolution in the area irradiated by the scan of the laser spot, in order to satisfy the condition that the length of one revolution on the circle scanned be evenly divisible by the dot length Ld at every radial position, θ is made 2π in formula (5), yielding $$fd=rNfc/Wd. \quad (6)$$

Figure 2:
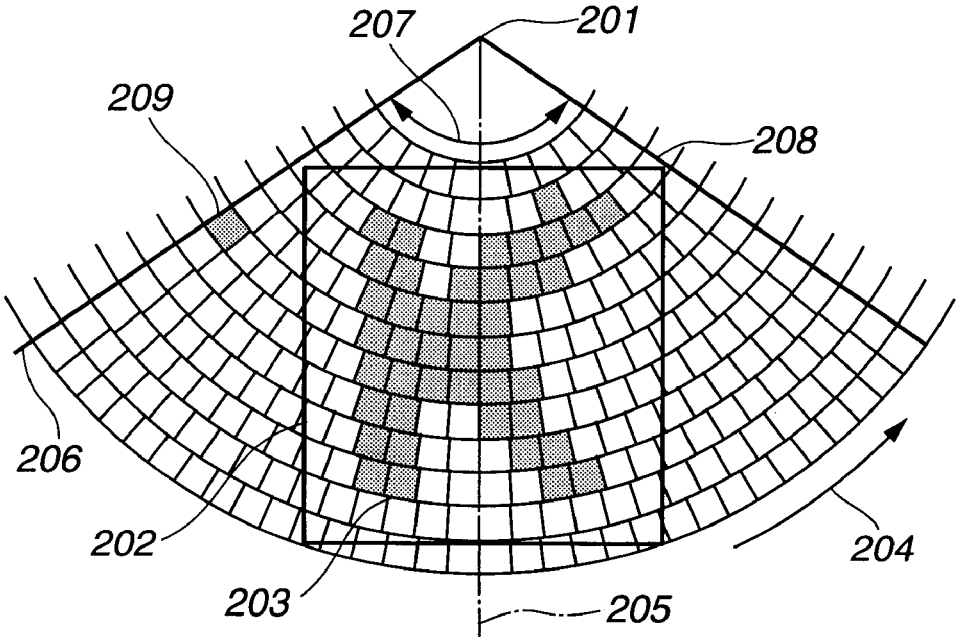
FIG. 2 is a diagram for describing a drawing pattern in a n embodiment aspect of the present invention.
Figure 3:
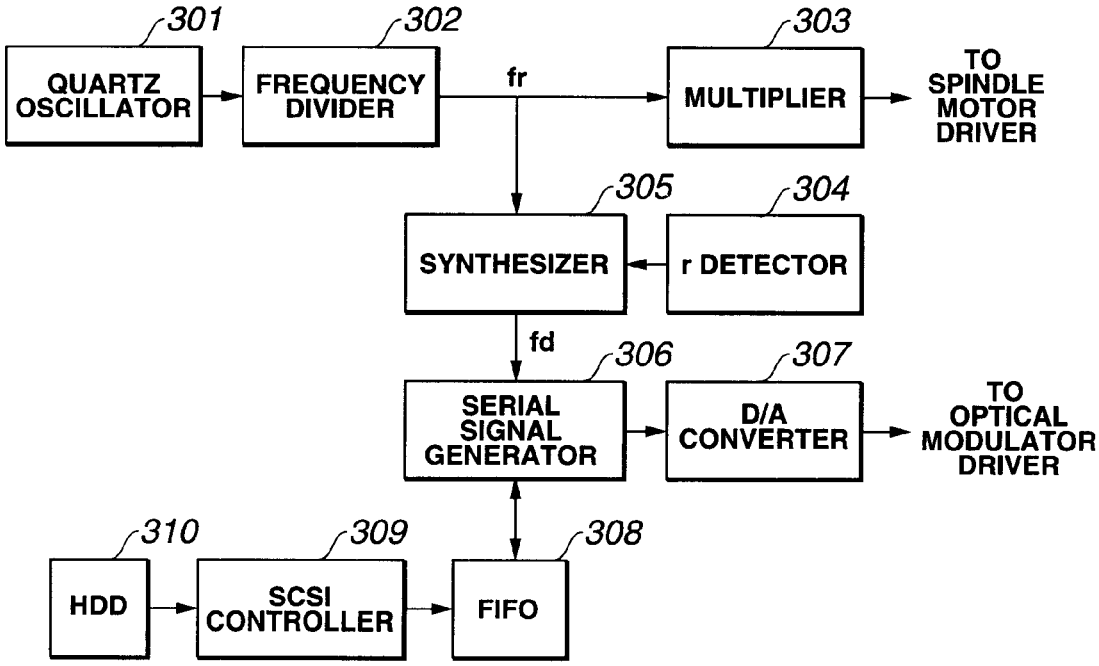
FIG. 3 is a block diagram for describing the configuration of a signal generator in a laser drawing apparatus in a first embodiment aspect of the present invention.

In order that, in a fan-shaped area where the center angle 207 is 2π/3 (rad) (i.e. 120°), for example, dots on the line segments 206 and 208 and on the center line 205 of the fan-shaped area, as diagrammed in FIG. 2, line up in a radial direction on the blank disk, it is sufficient that the length of the circular arc in the fan-shaped area with a center angle of π/3 (rad) be different from that circular arc adjacent in the radial direction on the blank disk by 1 dot length, at every radial position, that is, that there be a difference of 6 dot lengths in one revolution. If the dot width Wd is made 0.4μ, the rotational frequency fc of the turntable 109 is made 15 revolutions/second, and r is made 20.0 mm, then fd=4,500,000 (Hz)

Next, a signal generator for generating the optical modulator 103 control signals is described with reference to FIG. 3.

The oscillation frequency from a quartz oscillator 301 is lowered by a frequency divider 302. This frequency becomes the reference frequency fr of a synthesizer 305, equal to the fd frequency step. By doubling fr with a multiplier 303, a frequency is obtained for controlling the turning of the spindle motor 110. The spindle motor driver drives the spindle so that this signal is synchronized with the output signal of a rotary encoder attached to the spindle motor 110. If, for example, the turning speed is 15.0 revolutions/second and the number of rotary encoder output pulses per revolution of the spindle motor 110 is 4200, the output of the multiplier 303 becomes 15.0×4200=63.0 kHz.

The radius rO and feed pitch Tp at which drawing will begin is preset in an r detector 304, and the number of revolutions is counted, based on the output signal from the multiplier 303, and the current radius r is maintained. The multiplier ratio of the synthesizer 305 is also output based on the r value.

The synthesizer 305 doubles the frequency fr of the output signal from the frequency divider 302 based on the multiplier ratio output by the r detector 304 and output to a serial signal generator 306.

The serial signal generator 306 reads out data output from a FIFO memory 308 once every period, and converts data to a dot pattern line for one period. The FIFO memory 308 is a memory that outputs data in the same order as input.

Meanwhile, dot unit information for the pattern to be formed is stored beforehand in a HDD 310. When the size and depth of cutting into the photoresist does not change from dot to dot, the exposure light quantity may be altered dot by dot, and respective pulse peak value data for the control signals are stored. When the dots are arrayed in XY coordinates in the desired pattern prototype, the data array is converted by polar coordinate conversion so as to yield a dot pattern lined up in a circular arc shape, and recorded. These data are read by an SCSI controller 309 and output to the FIFO memory 308.

A D/A converter 307 generates control signals for the optical modulator 103 based on signals output from the serial signal generator 306 and outputs those to an optical modulator driver.

With the laser drawing apparatus and laser drawing method described in the foregoing, it is possible to make the lengths of the dots configuring the pattern equal for any radius position, providing a feature whereby the fineness of the pattern shape drawn is the same at the inner and outer circumference. Also, laser irradiation and drawing are done while turning at high speed, wherefore any pattern can be drawn at a higher speed than with a conventional XY table type laser drawing apparatus.

Second Embodiment Aspect of Invention

Figure 4:
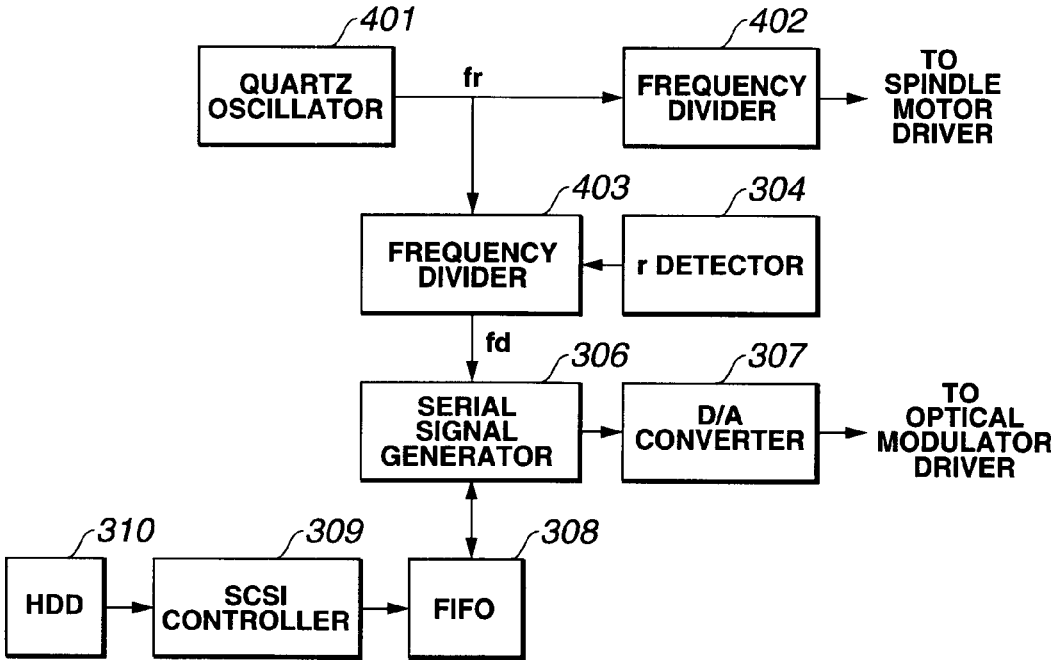
FIG. 4 is a block diagram for describing the configuration of a signal generator in a laser drawing apparatus in a second embodiment aspect of the present invention.
Figure 5:
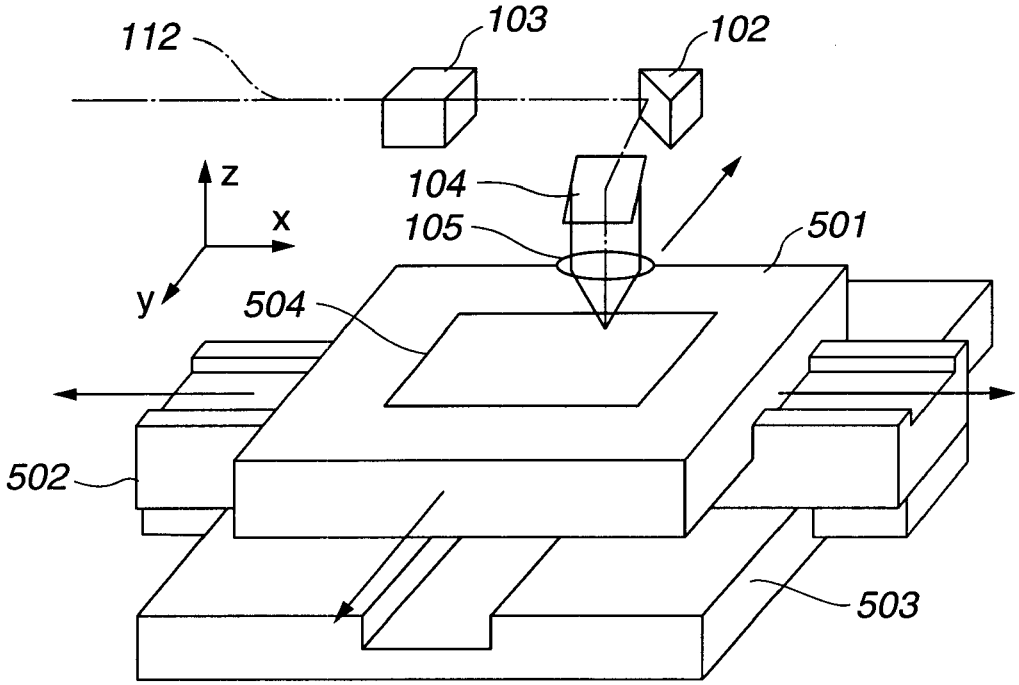
FIG.5 PRIOR ART
FIG. 5 is a model diagram of the overall structure of a conventional XY-table type laser drawing apparatus.
Figure 6:
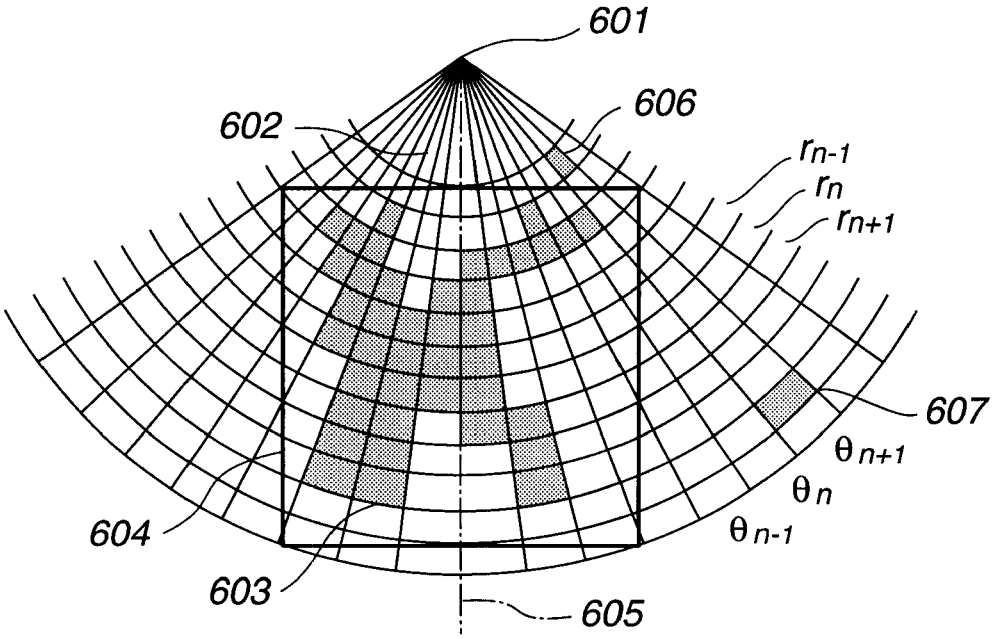
FIG.6 PRIOR ART
FIG. 6 is a diagram for describing a drawing pattern when using a conventional turntable type laser drawing apparatus.

Next are described a laser drawing apparatus and a laser drawing method wherein that apparatus is used, in a second embodiment aspect of the present invention, with reference to FIGS. 1, 2, and 4.

The basic configuration of the apparatus diagrammed in FIG. 1 is the same as that described in the first embodiment aspect. Here will be described a case where some desired pattern is exposed on a photoresist coated on the surface of a substantially circular blank glass disk 108.

In this embodiment aspect, it is assumed that the speed wherewith the laser spot scans in the circumferential direction on the blank glass disk 108 (hereinafter called the line speed) is constant, wherefore the turntable r.p.m. varies according to the position of the laser spot in the radial direction of the blank disk.

In terms of the relationship between the control signal clock signal frequency fd input to the optical modulator 103, the laser spot scanning position radius r, and the rotational frequency fc of the turntable 109, formulas (5) and (6) given earlier hold even for cases where scanning is done with a constant line speed, as described above. In order, for example, for dots to line up in the radial direction on the line segments 206 and 208 and on the center line 205, with a center angle 207 of 2π/3 (rad) (120°), it is only necessary that the length of the circular arc within the fan shape having a center angle π/3 (rad) at any radial position be different by 1 dot length with the adjacent circular arc, that is, a difference of 6 dot lengths in one period, wherefore we obtain N=6. If the dot width Wd is made 0.4μ, the clock signal frequency fd made 5.0 MHz, and the radius r made 20.0 mm, then the turntable 109 rotational frequency fc will be fc=16.67 (Hz).

Next is described a signal generator for generating control signals for controlling the spindle motor 110 and the optical modulator 103, with reference to FIG. 4.

A quartz oscillator 401 generates a reference frequency fr. By dividing fr with a frequency divider 403, the clock signal frequency fd required for the control signal of the optical modulator 103 is generated. Meanwhile, in the frequency divider 402, a frequency for controlling the turning of the spindle motor 110 is obtained from fr and a frequency division ratio output by the r detector 304. The spindle motor driver drives the spindle so that this signal is synchronized with the output signal of a rotary encoder attached to the spindle motor 110. If, for example, the turning speed at some radius is 16.67 revolutions/second and the number of rotary encoder output pules per revolution of the spindle motor 110 is 4200, the output of the frequency divider 402 becomes 16.67×4200=70.0 kHz.

The radius rO and feed pitch Tp at which drawing will begin is preset in an r detector 304, and the number of revolutions is counted, based on the output signal from the frequency divider 402, and the current radius r is maintained. The frequency division ratio of the frequency divider 402 is also output based on the r value.

A serial signal generator 306 reads out data output from a FIFO memory 308 once every period, and converts data to a dot pattern line for one period. This dot pattern is synchronized with the clock signal frequency fd and output to the D/A converter 307. The FIFO memory 308 is a memory that outputs data in the same order as input.

Meanwhile, dot unit information for the pattern to be formed is stored beforehand in an HDD 310. When the dots are arrayed in XY coordinates in the desired pattern prototype, the data array is converted by polar coordinate conversion so as to yield a dot pattern lined up in a circular arc shape, and recorded. These data are read by an SCSI controller 309 and output to the FIFO memory 308.

A D/A converter 307 generates control signals for the optical modulator 103 based on signals output from the serial signal generator 306 and outputs those to an optical modulator driver.

With the laser drawing apparatus in this embodiment aspect, it is possible to make the length of the dots configuring the pattern the same for any radial position, as in the laser drawing apparatus in the first embodiment aspect, and the feature of the precision of the pattern shape drawn being the same at the inner and outer circumference is realized. Also, drawing is done while turning at high speed, wherefore any pattern can be drawn at a higher speed than with a conventional XY table type laser drawing apparatus.

According to the present invention, as described in detail in the foregoing, a laser drawing apparatus can be provided wherewith it is possible to draw very fine patterns at high speed and with uniform fine precision.

What is claimed is:

1. A laser drawing method comprising:

condensing laser light to form a laser spot on revolving material to be processed;

synchronizing control signals input to an optical modulator by a clock signal obtained from an oscillator;

adjusting a frequency fd of said clock signal so that $fd=rNfc/Wd$, where r is distance of said laser spot formed on said material to be processed from a turning center of said material to be processed, fc is rotational frequency of said material to be processed, Wd is length in radial dimension of said laser spot formed on said material to be processed, and N is a positive integer;

varying a light intensity of said laser spot by said optical modulator in synchronization with said control signals; and laser-drawing a discretionary pattern on said material to be processed.

2. The laser drawing method according to claim 1, wherein rotational frequency fc of said material to be processed is constant.

3. The laser drawing method according to claim 1, wherein frequency fd of said clock signal is constant.

4. The laser drawing method of claim 1, wherein said discretionary pattern is fan-shaped.

5. A laser drawing method comprising:

condensing laser light to form a laser spot on revolving material to be processed;

synchronizing control signals input to an optical modulator by a clock signal obtained from an oscillator;

adjusting a frequency fd of said clock signal so that $fd=2\pi rNfc/\theta Wd$, where r is distance of said laser spot formed on said material to be processed from a turning center of said material to be processed, fc is rotational frequency of said turntable, Wd is length in radial dimension of said laser spot formed on said material to be processed, θ is center angle of a fan-shaped area to be drawn, and N is a positive integer;

varying a light intensity of said laser spot by said optical modulator in synchronization with said control signals; and laser-drawing a discretionary pattern on said material to be processed.

6. The laser drawing method according to claim 5, wherein rotational frequency fc of said material to be processed is constant.

7. The laser drawing method according to claim 5, wherein frequency fd of said clock signal is constant.

8. The laser drawing method according to claim 1, wherein said material to be processed is a blank disk coated with a photosensitive material, and laser drawing is done on said photosensitive material.

9. The laser drawing method of claim 5, wherein said discretionary pattern is fan-shaped.

10. The laser drawing method according claim 5, wherein said material to be processed is a blank disk coated with a photosensitive material, and laser drawing is done on said photosensitive material.

11. A laser drawing method comprising:

condensing laser light to form a laser spot on revolving semiconductor to be processed;

synchronizing control signals input to an optical modulator by a clock signal obtained from an oscillator;

adjusting a frequency fd of said clock signal so that $fd=rNfc/Wd$, where r is distance of said laser spot formed on said semiconductor to be processed from a turning center of said semiconductor to be processed, fc is rotational frequency of said semiconductor to be processed, Wd is length in radial dimension of said laser spot formed on said semiconductor to be processed, and N is a positive integer;

varying a light intensity of said laser spot by said optical modulator in synchronization with said control signals; and laser-drawing a discretionary pattern on said semiconductor to be processed.

12. A laser drawing method comprising;

condensing laser light to form a laser spot on revolving hologram to be processed;

synchronizing control signals input to an optical modulator by a clock signal obtained from an oscillator;

adjusting a frequency fd of said clock signal so that $fd=rNfc/Wd$, where r is distance of said laser spot formed on said hologram to be processed from a turning center of said hologram to be processed, fc is rotational frequency of said hologram to be processed, Wd is length in radial dimension of said laser spot formed on said hologram to be processed, and N is a positive integer;

varying a light intensity of said laser spot by said optical modulator in synchronization with said control signals; and laser-drawing a discretionary pattern on said hologram to be processed.

* * * * *

UNITED STATES PATENT AND TRADEMARK OFFICE

CERTIFICATE OF CORRECTION

PATENT NO. : 6,512,535 B1 
DATED : March 18, 2003
INVENTOR(S) : Kimio Nagasaka and Akira Miyamae It is certified that error appears in the above-identified patent and that said Letters Patent is hereby corrected as shown below:

Column 3,
Lines 28-29, “a n” should be -- an --

Column 5,
Line 2, “by]” should be -- by: --
Line 25, after “000 (Hz)” insert a period Column 8,
Line 45, “comprising;” should be -- comprising: --

Signed and Sealed this

Twenty-second Day of April, 2003

JAMES E. ROGAN
*Director of the United States Patent and Trademark Office*